US011139612B2

(12) United States Patent
Kim et al.

(10) Patent No.: US 11,139,612 B2
(45) Date of Patent: Oct. 5, 2021

(54) CONNECTOR ASSEMBLY WITH CONNECTOR POSITION ASSURANCE MEMBER

(71) Applicants: HYUNDAI MOTOR COMPANY, Seoul (KR); KIA MOTORS CORPORATION, Seoul (KR); APTIV CONNECTION SYSTEMS KOREA LLC., Hwaseong-si (KR)

(72) Inventors: Mun Jong Kim, Suwon-si (KR); Jae Sang Lim, Hwaseong-si (KR)

(73) Assignees: HYUNDAI MOTOR COMPANY, Seoul (KR); KIA MOTORS CORPORATION, Seoul (KR); APTIV CONNECTION SYSTEMS KOREA LLC., Hwaseong-si (KR)

( * ) Notice: Subject to any disclaimer, the term of this patent is extended or adjusted under 35 U.S.C. 154(b) by 0 days.

(21) Appl. No.: 16/991,287

(22) Filed: Aug. 12, 2020

(65) Prior Publication Data

US 2021/0083427 A1 Mar. 18, 2021

(30) Foreign Application Priority Data

Sep. 18, 2019 (KR) ..... 10-2019-0114500

(51) Int. Cl.
*H01R 13/40* (2006.01)
*H01R 13/629* (2006.01)

(52) U.S. Cl.
CPC . *H01R 13/62927* (2013.01); *H01R 13/62922* (2013.01)

(58) Field of Classification Search
CPC ..... H01R 13/4223; H01R 13/4365; H01R 13/6215; H01R 13/514; H01R 2103/00; H01R 13/41
USPC ..... 439/752.5, 595, 362–364, 594, 598, 733
See application file for complete search history.

(56) References Cited

U.S. PATENT DOCUMENTS

| | | | | |
|---|---|---|---|---|
| 6,857,892 | B2 * | 2/2005 | McLauchlan | H01R 13/6272 439/352 |
| 6,964,579 | B2 * | 11/2005 | Seminars | F42B 3/26 439/188 |
| 7,201,599 | B2 * | 4/2007 | Holub | H01R 13/506 439/352 |
| 7,399,195 | B2 * | 7/2008 | Kim | H01R 13/641 439/352 |
| 7,404,731 | B2 * | 7/2008 | Lim | H01R 13/641 439/358 |
| 2005/0176297 | A1 * | 8/2005 | Dillon | H01R 13/6275 439/595 |

* cited by examiner

*Primary Examiner* — Phuong Chi Thi Nguyen
(74) *Attorney, Agent, or Firm* — McDonnell Boehnen Hulbert & Berghoff LLP

(57) ABSTRACT

The present disclosure relates to a connector assembly with a connector position assurance member which may reduce a defect rate in engaging connectors to each other, and an object of the present disclosure is to provide a connector assembly in which a connector position assurance (CPA) member is automatically operated to lock a lever when the lever completes its operation for engaging the female and male connectors to each other.

13 Claims, 13 Drawing Sheets

CONNECTOR ASSEMBLY WITH CONNECTOR POSITION ASSURANCE MEMBER

CROSS REFERENCE TO RELATED APPLICATIONS

This application claims under 35 U.S.C. § 119(a) the benefit of priority to Korean Patent Application No. 10-2019-0114500 filed on Sep. 18, 2019, the entire contents of which are incorporated herein by reference.

BACKGROUND

(a) Technical Field

The present disclosure relates to a connector assembly, and more particularly, to a connector assembly with a connector position assurance member which may reduce a defect rate in engaging connectors to each other.

(b) Background Art

In general, a connector assembly may include a female connector and a male connector. Each of the female and male connectors may include a housing and a terminal. When the housings of the female and male connectors are mechanically engaged to each other, the terminals of the female and male connectors may be physically and electrically connected to each other.

For a firm connection between the terminal of the female connector and the terminal of the male connector, the female and male connectors may be engaged to each other by a strong engagement force. In order to generate a sufficient engagement force, the connector assembly may include a lever.

Referring to FIG. 21, a lever 8 of a conventional connector assembly may allow the female and male connectors to be completely engaged to each other using a lever principle. To this end, the lever 8 may be rotatably installed on a cover 9 of the connector assembly.

When the lever 8 is operated arbitrarily, the female connector and the male connector may be disengaged from each other. In order to prevent the lever 8 from being operated arbitrarily, the connector assembly may include a connector position assurance (CPA) member 7.

The CPA member 7 may prevent the lever 8 from being operated arbitrarily. That is, the CPA member 7 may prevent the lever 8 from being operated arbitrarily, thereby reducing incomplete rate or defect rate in engaging the connectors to each other.

Further, after engaging the female and male connectors to each other, the CPA member 7 may include a marker 7*a* which may be matched with a marker 9*a* of the cover 9 in order to be able to visually check whether the connectors are completely engaged to each other.

As illustrated in FIG. 21, the CPA member 7 may be operated to rotate the lever 8 in order to engage the female and male connectors to each other, and then move toward the lever 8 to lock the lever 8. Here, the CPA member 7 needs to be operated separately after operating the lever 8. Accordingly, usage of the CPA member 7 leads to a disadvantage in that the work man-hour is increased in engaging the connectors to each other.

Further, the connector assembly has further disadvantages in that markers 7*a* and 9*a* need to be marked with the cover 9 and the CPA member 7, respectively, to visually identify whether the connectors are completely engaged to each other and the CPA member 7 needs to be integrally formed with the cover 9 due to a structure of the cover 9.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to solve the above-described problems associated with prior art. An object of the present disclosure is to provide a connector assembly in which a connector position assurance (CPA) member is automatically operated to lock a lever when the lever completes an operation for engaging the female and male connectors to each other.

In one aspect, the present disclosure provides a connector assembly including a cover covering one end of a first connector, a lever rotatably engaged to a lower portion of the cover, a connector position assurance (CPA) member slidably mounted to a mounting portion formed on an upper portion of the cover, a cover locking portion formed on the mounting portion and restricting the CPA member from sliding toward a front of the mounting portion, and an elastic member disposed behind the mounting portion and pressing the CPA member toward a front of the mounting portion, in which when the lever is rotated in a first direction, the CPA member is released from a sliding restriction of the cover locking portion, slides toward the front of the mounting portion by the elastic member, and locks the lever. The first direction is a rotational direction of the lever for engaging the first connector and a mating connector of the first connector to each other.

The connector assembly configured as described above has the following features:

The CPA member may include an unlock bar pressed downward by the lever rotated in the first direction, stopping portions formed on side surfaces of the unlock bar and thus caught by the cover locking portion and released from being caught by the cover locking portion when the unlock bar is pressed downward, and a CPA locking portion disposed at a predetermined interval on an upper surface of the unlock bar and sliding over a locked portion of the lever when the stopping portions are released from being caught by the cover locking portion. When the CPA locking portion is mounted on the locked portion, the CPA locking portion may prevent the lever from being rotated in a second direction which is opposite to the first direction. Grooves may be formed on upper surfaces of the stopping portions and the cover locking portion may enter the grooves when the stopping portions are released from being caught by the cover locking portion.

A lower surface of the cover locking portion may be formed to be inclined and thus in contact with front wall surfaces of the grooves when the CPA member slides toward a rear of the mounting portion. Accordingly, when the CPA member slides toward the rear of the mounting portion, the lower surface of the cover locking portion may thus slide along the front wall surfaces of the grooves to leave the grooves.

In addition, the CPA member may include engaging slots disposed on left and right sides of the unlock bar and when the CPA member is mounted on the mounting portion, ribs of the mounting portion may be slid and inserted into the engaging slots.

A cover slot may be disposed behind the mounting portion on the upper portion of the cover, and the elastic member may be disposed adjacent to a pressed portion formed on a lower portion of the CPA member to be compressed and restored in the cover slot.

In addition, the lever may include rotating plate portions rotatably engaged to pin portions formed on lower portions of the cover, respectively, and the locked portion integrally formed with the rotating plate portions and pressing the unlock bar downward when the rotating plate portions are rotated in the first direction. A pressing protrusion may be formed on a lower surface of the locked portion and presses an upper surface of the unlock bar when the rotating plate portions are rotated in the first direction. In addition, an unlock groove portion may be formed on the upper surface of the unlock bar and the pressing protrusion may enter the unlock groove portion when the stopping portions are released from being caught by the cover locking portion.

In addition, lever markers may be formed on the rotating plate portions of the lever, and when the rotating plate portions are rotated in the first direction and the locked portion thus presses the unlock bar, the lever markers are positioned in line with the cover markers formed on side surfaces of the cover and the pin portions.

Other aspects and preferred embodiments of the disclosure are discussed infra.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

BRIEF DESCRIPTION OF THE FIGURES

The above and other features of the present disclosure will now be described in detail with reference to certain exemplary embodiments thereof illustrated the accompanying drawings which are given hereinbelow by way of illustration only, and thus are not limitative of the present disclosure, and wherein.

It should be understood that the appended drawings are not necessarily to scale, presenting a somewhat simplified representation of various preferred features illustrative of the basic principles of the disclosure. The specific design features of the present disclosure as disclosed herein, including, for example, specific dimensions, orientations, locations, and shapes will be determined in part by the particular intended application and use environment.

In the figures, reference numbers refer to the same or equivalent parts of the present disclosure throughout the several figures of the drawings.

DETAILED DESCRIPTION

Hereinafter, exemplary embodiments of the present disclosure so as to be easily practiced by a person skilled in the art to which the present disclosure pertains will be described in detail with reference to the accompanying drawings.

Figure 1:
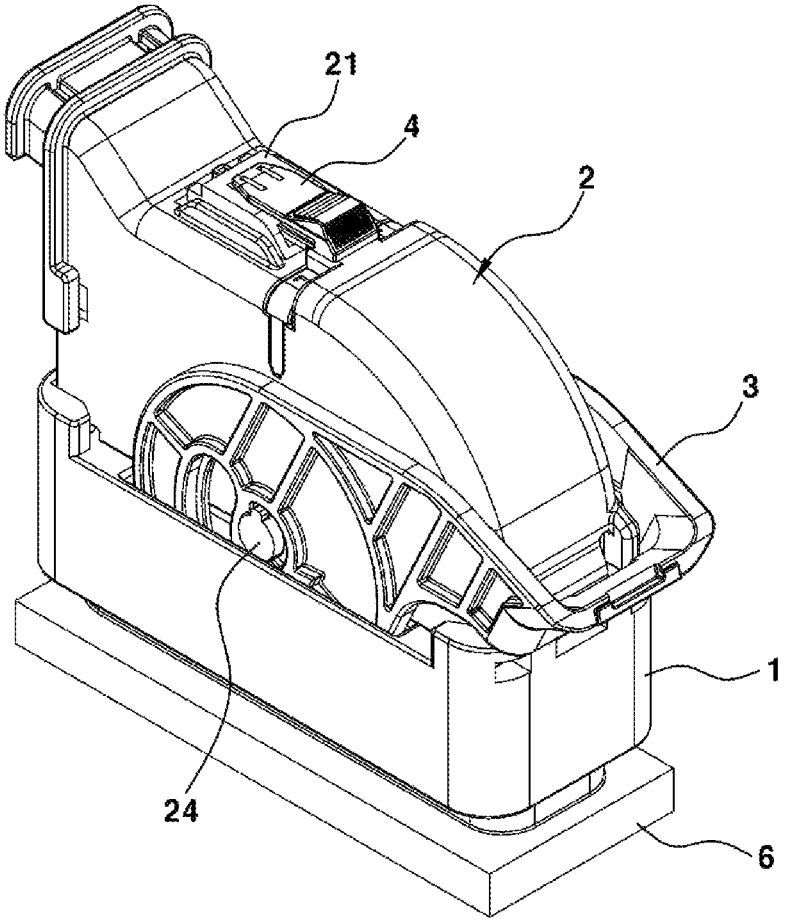
FIG. 1 is an engaged perspective view of a connector assembly according to the present disclosure.
Figure 2:
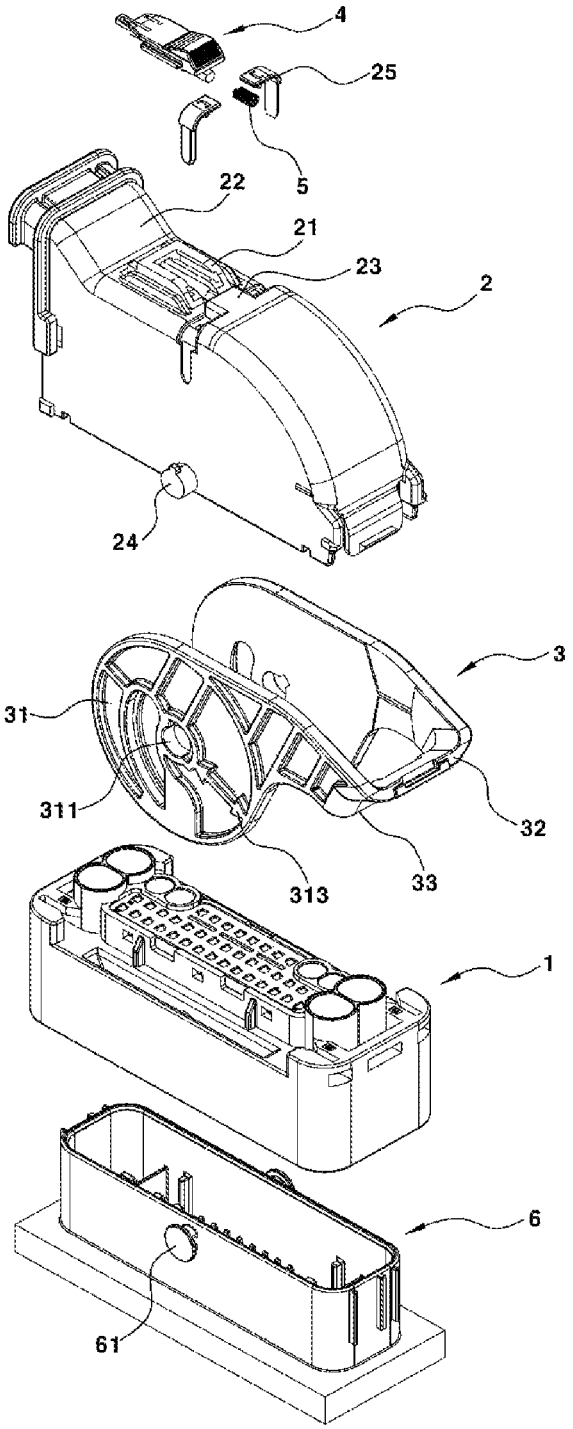
FIG. 2 is an exploded perspective view of a connector assembly according to the present disclosure.

As illustrated in FIGS. 1 and 2, a connector assembly of the present disclosure may include a first connector 1, a cover 2, a lever 3, a connector position assurance (CPA) member 4, an elastic member 5, and a second connector 6.

Terminals of the first connector 1 and the second connector 6 are omitted from FIGS. 1, 2 and the like. However, each of the first connector 1 and the second connector 6 may include the terminals for electrical connection therebetween. When the second connector 6, which is a mating connector of the first connector 1, and the first connector 1 are engaged to each other, the terminal of the first connector 1 and the terminal of the second connector 6 may be electrically connected to each other.

The cover 2 may be coupled to and cover one end of the first connector 1. The one end of the first connector 1 may be a portion exposed to the outside when the first connector 1 and the second connector are engaged to each other.

A mounting portion 21 on which the CPA member 4 is mounted may be formed on an upper portion of the cover 2, and pin portions 24 which are a rotation center of the lever 3 may be formed on lower portions of the cover 2. Further, a lever stop portion 22 and a cover slot 23 may be formed on the upper portion of the cover 2.

The mounting portion 21 may be disposed in the middle of the upper portion of the cover 2, the lever stop portion 22 may be disposed in the front of the mounting portion 21 and the cover slot 23 may be disposed behind the mounting portion 21.

Referring to FIGS. 2 to 7, the mounting portion 21 may have a structure in which the rear portion thereof is opened so that the CPA member 4 is accessible. In detail, the mounting portion 21 may have a substantially C-shaped structure. The mounting portion 21 may include a pair of ribs 212 on the upper portions thereof so that the CPA member 4 is assembled therewith. The pair of ribs 212 may be disposed on left side and right side of the mounting portion 21.

The CPA member 4 may be mounted to the mounting portion 21 while sliding between the pair of ribs 212. The mounting portion 21 may have a space in which an unlock bar 41 of the CPA member 4 may enter below the ribs 212. The ribs 212 may be disposed behind a cover locking portion 211 which restricts movement of the CPA member 4.

In addition, only a rear end of the mounting portion 21 may be integrally connected to the upper portion of the cover 2 and portions other than the rear end thereof may be separated from the upper portion of the cover 2. The mounting portion 21 may be formed so that only the rear end thereof is integrally connected with the cover 2, and accordingly, when a front end of the mounting portion 21 is pressed downward, the mounting portion 21 may be elastically bent with reference to the rear end thereof.

The lever stop portion 22 is a portion on which an inclined surface portion 32 of the lever 3 may be mounted at a predetermined interval when the lever 3 completes its rotation in a first direction. The inclined surface portion 32 may be disposed at the predetermined interval on the lever stop portion 22 when the first connector 1 and the second connector are fully engaged to each other. That is, the lever stop portion 22 may be positioned below the inclined surface portion 32 when the first connector 1 and the second connector are fully engaged. In detail, the lever stop portion 22 may be formed to be inclined at a predetermined angle corresponding to an inclination angle of the inclined surface portion 32.

The first direction is a rotational direction of the lever 3 for engaging the first connector 1 and the second connector 6 to each other.

The cover slot 23 may have an inner space into which the elastic member 5 is inserted. The elastic member 5 may be inserted into the cover slot 23 and mounted thereon. The elastic member 5 may be compressed and restored in the cover slot 23 in a longitudinal direction of the cover slot 23. The elastic member 5 may be compressed by being pushed by a pressed portion 45 of the CPA member 4; and here, a rear end of the elastic member 5 may be supported on a rear wall surface of the cover slot 23.

The cover slot 23 may have a length in which the elastic member 5 in an uncompressed state is completely inserted thereinto. In detail, the cover slot 23 may have the same length as the elastic member 5 in the uncompressed state.

The pin portions 24 may protrude from lower portions of the cover 2, respectively. The pin portions 24 may be formed on a lower left side surface and a lower right side surface of the cover 2 with reference to the mounting portion 21, respectively.

Figure 6:
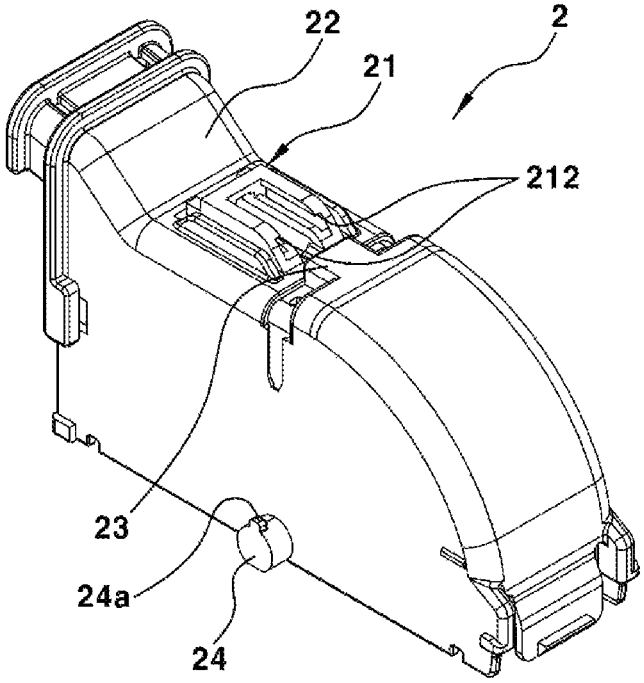
FIG. 6 is a perspective view of a cover.
Figure 7:
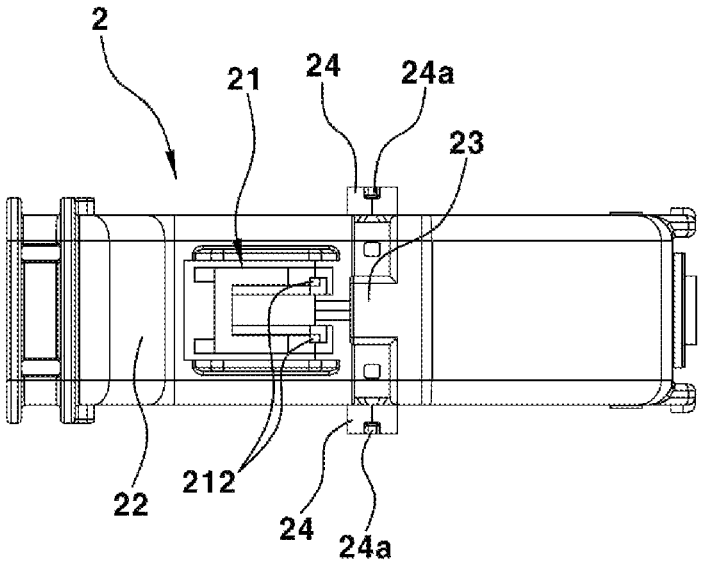
FIG. 7 is a plan view of a cover.

Protrusion 24*a*, shown in FIGS. 6 and 7, may protrude from an outer circumferential surface of each of the pin portions 24. The protrusion 24*a* may guide a rotation angle of the lever 3. In detail, the protrusion 24*a* may restrict the rotation angle of the lever 3 rotated in the first direction and the rotation angle of the lever 3 rotated in a second direction. To this end, rotating plate portions 31 of the lever 3 may include guide grooves 311*a*, respectively. The second direction is opposite to the first direction.

Figure 8:
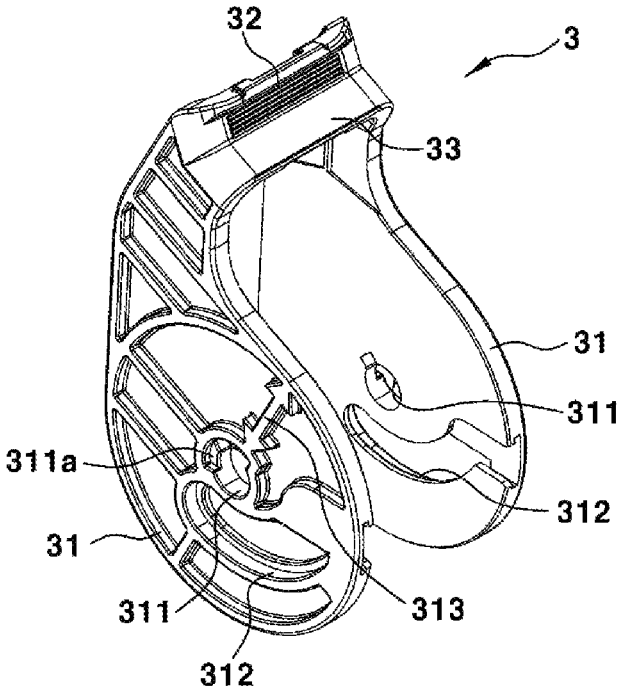
FIG. 8 is a perspective view of a lever.

As illustrated in FIGS. 1, 2 and 8, the lever 3 may be rotatably mounted to the cover 2 about the pin portions 24. The lever 3 may include a pair of rotating plate portions 31 having assembly holes 311 into which pin portions 24 are inserted, respectively, and the inclined surface portion 32 and a locked portion 33 formed integrally with the pair of rotating plate portions 31.

The pair of rotating plate portions 31 may be disposed on the left side surface and the right side surface of the cover 2 when assembled to the pin portions 24. The inclined surface portion 32 may be formed integrally with the locked portion 33, and the inclined surface portion 32 and the locked portion 33 may be disposed between the pair of rotating plate portions 31. The inclined surface portion 32 may be disposed in front of the locked portion 33 when mounted on the upper portion of the lever stop portion 22.

The guide grooves 311*a* may be formed adjacent to the assembly holes 311 in the rotating plate portions 31. Each guide groove 311*a* may restrict the rotation angle of the rotating plate portion 31 by the protrusion 24*a*. In detail, the guide groove 311*a* may guide a stop position of the lever 3 when rotated in the first direction and a stop position of the lever 3 when rotated in the second direction.

In addition, each of the rotating plate portions 31 may include a cam slot 312 to engage the first connector 1 and the second connector 6 to each other. The cam slot 312 may be disposed from a middle portion to the edge portion of the rotating plate portion 31, and one end of the cam slot 312 may be opened so that an interlocking pin 61 of the second connector 6 is accessible.

Figure 20:
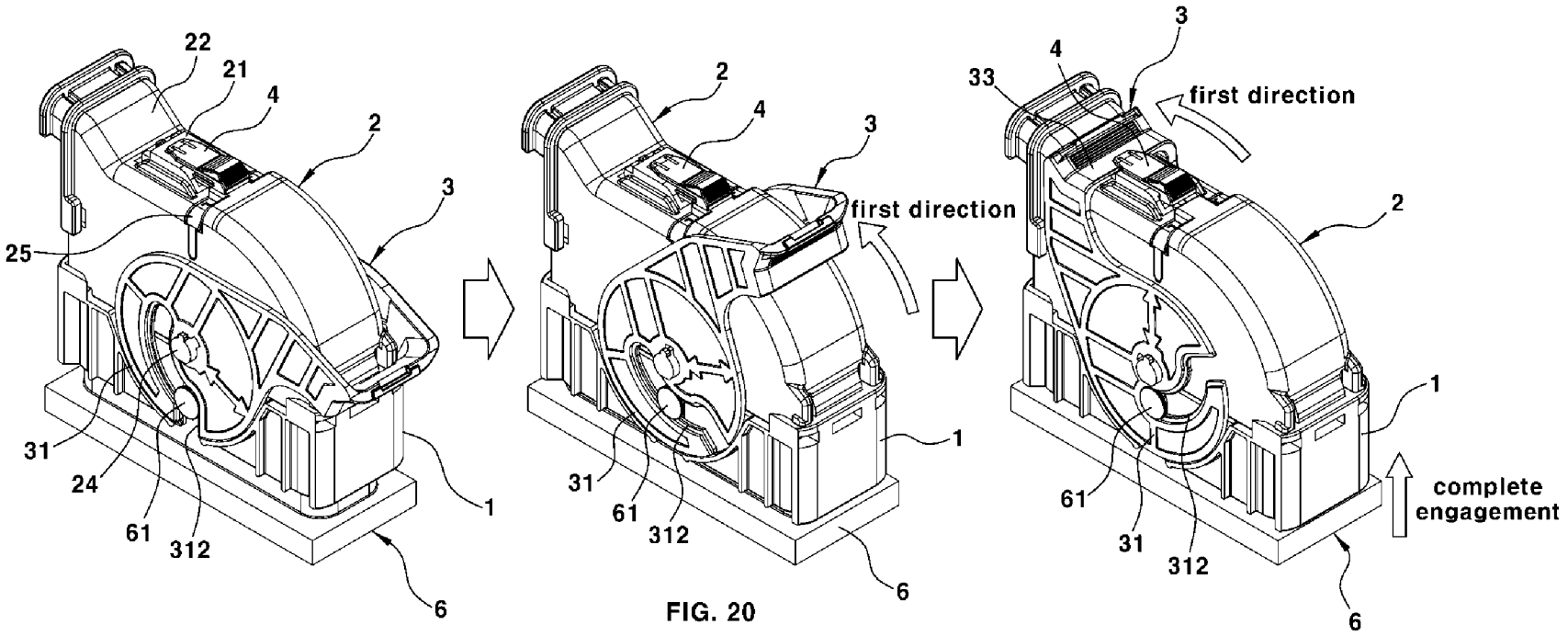
FIG. 20 is a view illustrating a process in which the first connector and the second connector are engaged to each other by the lever.
Figure 21:
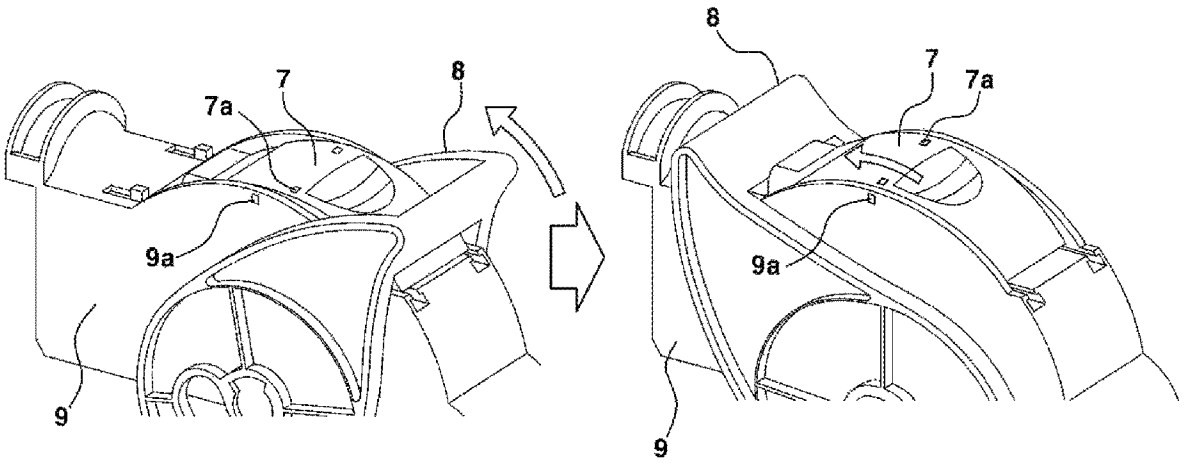
FIG. 21 PRIOR ART
FIG. 21 is a view illustrating a process in which the CPA member is operated separately after the lever of a prior art connector assembly is operated.

Referring to FIG. 20, when the rotating plate portion 31 is rotated in the first direction in a state in which the interlocking pin 61 of the second connector 6 enters the cam slot 312, the interlocking pin 61 is moved along a trajectory of the cam slot 312, the second connector 6 is then pulled toward the first connector 1, and accordingly, the first connector 1 and the second connector 6 are engaged to each other. The first direction is a rotational direction of the rotating plate portion 31 for engaging the first connector 1 and the second connector 6 to each other.

That is, the lever 3 may engage the first connector 1 and the second connector 6 to each other when rotated about each pin portion 24 in the first direction. When disengaging the first connector 1 and the second connector 6 from each other, the lever 3 is rotated in the second direction.

Figure 11:
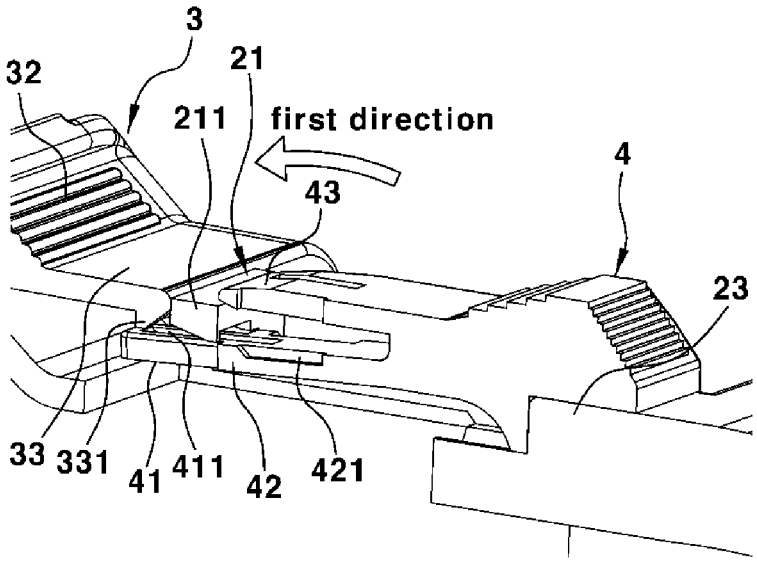
FIGS. 11 and 12 are cutaway perspective views illustrating a state in which the CPA member is unlocked as the lever is rotated.
Figure 12:
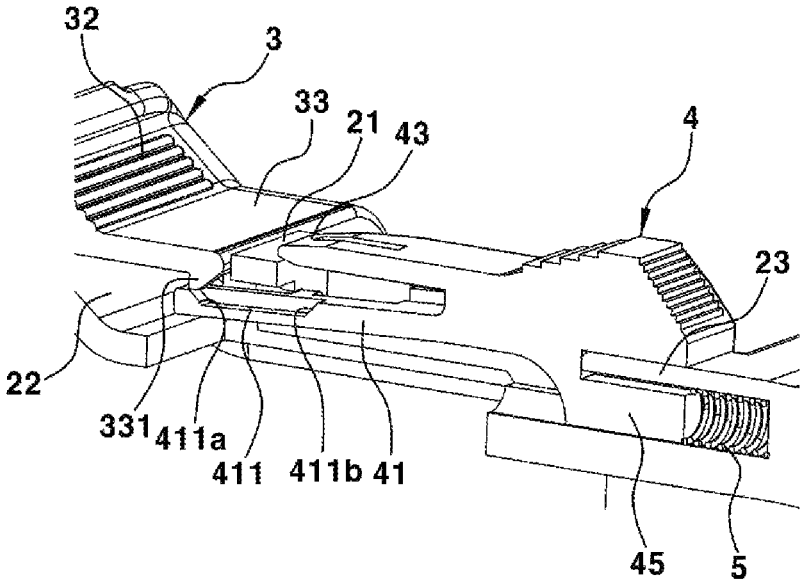

Referring to FIGS. 11 and 12, a pressing protrusion 331 may be formed on a lower surface of the locked portion 33. The pressing protrusion 331 may protrude from a center of the lower surface of the locked portion 33. The pressing protrusion 331 may be disposed on the lower surface of the locked portion 33 to match a position of an unlock groove portion 411 of the CPA member 4. The pressing protrusion 331 may press the unlock bar 41 of the CPA member 4 downward when the lever 3 completes its rotation in the first direction.

Figure 13:
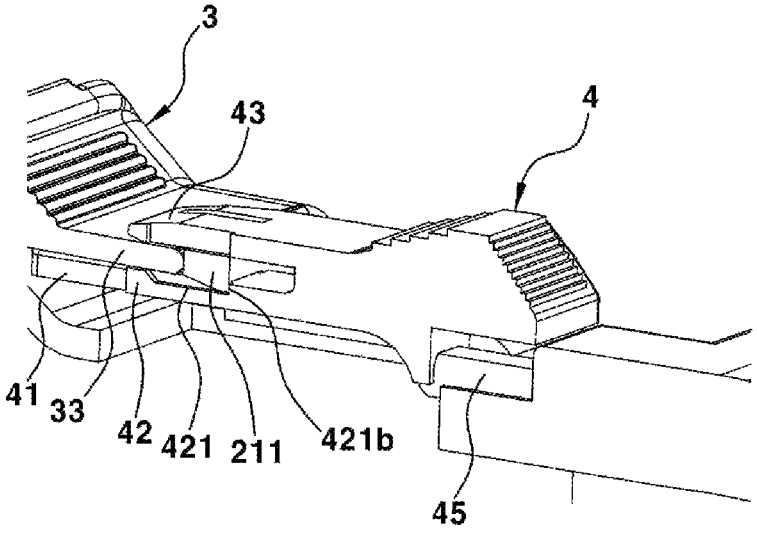
FIGS. 13 and 14 are cutaway perspective views illustrating a state in which the CPA member is engaged with the lever.
Figure 14:
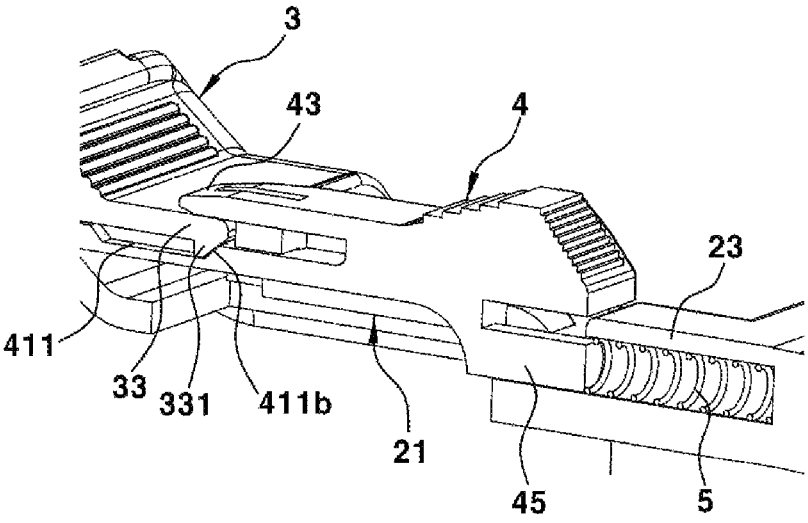

Referring to FIGS. 13 and 14, the CPA member 4 may prevent the lever 3 from being inadvertently operated in the second direction after the lever 3 is rotated in the first direction and the first connector 1 and the second connector 6 are then engaged to each other. That is, the CPA member 4 may prevent disengagement of the first connector 1 and the second connector 6 as the lever 3 is inadvertently operated in the second direction.

Figure 9:
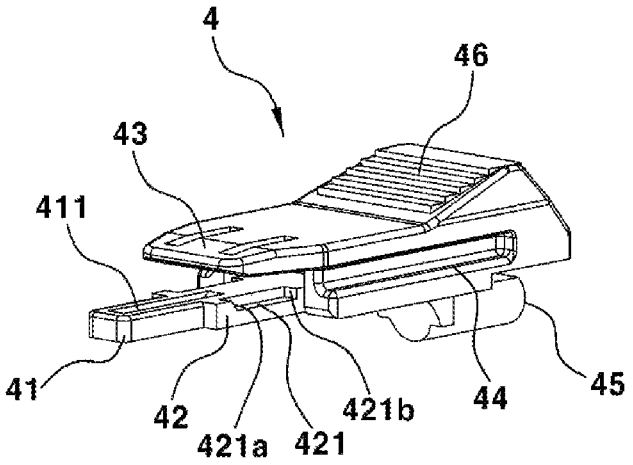
FIGS. 9 and 10 are perspective views of a connector position assurance (CPA) member.
Figure 10:
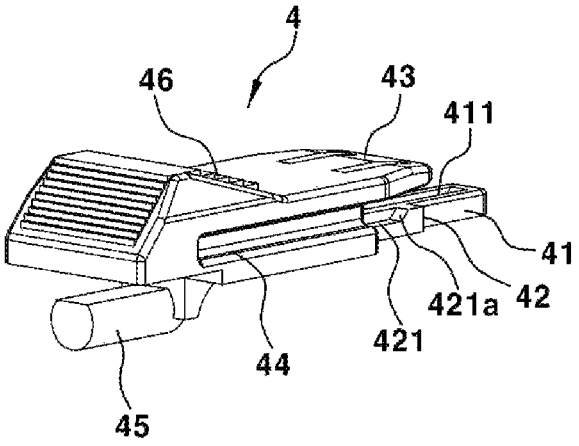

As illustrated in FIGS. 9 and 10, the CPA member 4 may include the unlock bar 41, stopping portions 42, engaging slots 44, the pressed portion 45, a CPA locking portion 43 and the like.

Figure 3:
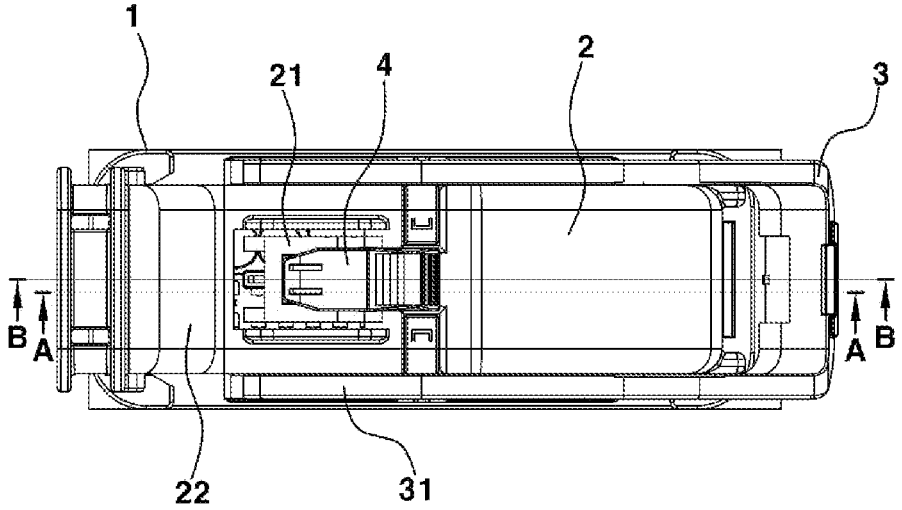
FIG. 3 is a plan view of a connector assembly according to the present disclosure.
Figure 4:
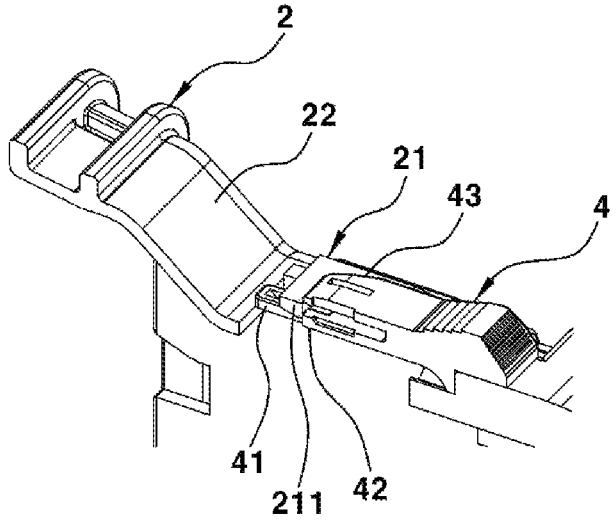
FIG. 4 is a cutaway perspective view taken along a line A-A of FIG. 3.
Figure 5:
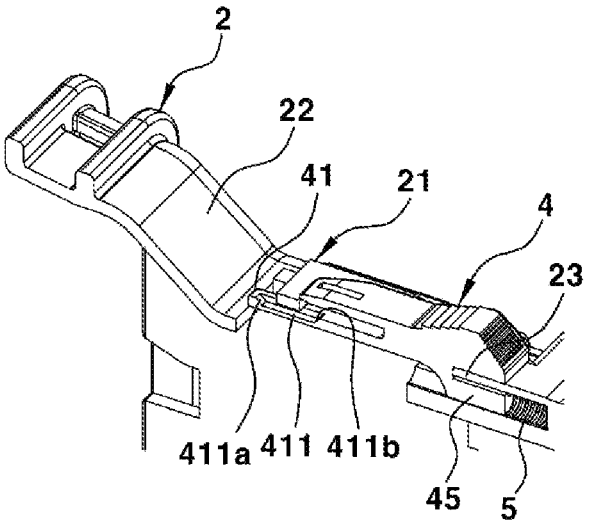
FIG. 5 is a cross-sectional view taken along a line B-B of FIG. 3.

Referring to FIGS. 3 to 5, when the CPA member 4 is assembled to the mounting portion 21, the unlock bar 41 may pass through the front end of the mounting portion 21 and protrude forward of the mounting portion 21. When the unlock bar 41 passes through the front end of the mounting portion 21, a front end of the unlock bar 41 may be disposed at a predetermined interval from a rear of the lever stop portion 22. When the inclined surface portion 32 of the lever 3 is mounted on the lever stop portion 22, the unlock bar 41 may be pressed by the locked portion 33 of the lever 3 to be bent downward.

The stopping portions 42 may protrude from side surfaces of the unlock bar 41. In detail, the stopping portions 42 may protrude from the left side surface and the right side surface of the unlock bar 41. The stopping portions 42 may be caught by the cover locking portion 211 of the mounting portion 21 when the CPA member 4 is engaged to the mounting portion 21. When the stopping portions 42 are caught by the cover locking portion 211, the CPA member 4 may be restricted from moving forward. When the stopping portions 42 are caught by the cover locking portion 211, the CPA member 4 may be blocked from sliding toward the lever stop portion 22.

When the stopping portions 42 are caught by the cover locking portion 211, the pressed portion 45 may be inserted into the cover slot 23 to compress the elastic member 5. Here, the pressed portion 45 may be pressed forward by the compressed elastic member 5. The elastic member 5 may push the pressed portion 45 toward the mounting portion 21 by an elastic restoring force. The pressed portion 45 may be linearly moved in the cover slot 23. The pressed portion 45 is adjacent to a front end of the elastic member 5 and may thus receive the elastic restoring force.

When the unlock bar 41 is bent downward, the stopping portions 42 may be released from being caught by the cover locking portion 211. When the stopping portions 42 are released from being caught by the cover locking portion 211, the CPA member 4 may be moved forward by the elastic member 5.

Grooves 421 may be formed on upper surfaces of the stopping portions 42 to prevent interference of the cover locking portion 211. When the stopping portions 42 are released from being caught by the cover locking portion 211 and the CPA member 4 is moved toward the lever stop portion 22, the cover locking portion 211 may enter the grooves 421 and move along the grooves 421.

The cover locking portion 211 may be formed at the front end of the mounting portion 21. The cover locking portion 211 may restrict the CPA member 4 from sliding forward until the unlock bar 41 is pressed by the locked portion 33 of the lever 3.

When the stopping portions 42 are released from being caught by the cover locking portion 211, the unlock groove portion 411 may be formed on an upper surface of the unlock bar 41 to allow the CPA locking portion 43 to slide smoothly on the locked portion 33 of the lever 3.

Referring to FIG. 5, the unlock groove portion 411 may have a front inclined surface 411*a* and a rear inclined surface 411*b*. The front inclined surface 411*a* may be disposed at a front end of the unlock groove portion 411 and the rear inclined surface 411*b* may be disposed at a rear end of the unlock groove portion 411.

Referring to FIG. 12, the front inclined surface 411*a* may be pressed by the pressing protrusion 331 of the locked portion 33 when the lever 3 completes its rotation in the first direction. The front inclined surface 411*a* may be formed to be inclined at a predetermined angle. When the front inclined surface 411*a* may be pressed by the pressing protrusion 331, the unlock bar 41 is bent downward. As the unlock bar 41 is bent downward, the stopping portions 42 may be released from being caught by the cover locking portion 211. Here, the pressing protrusion 331 may slide along the front inclined surface 411*a* to enter the unlock groove portion 411. The unlock bar 41 may be moved forward until the pressing protrusion 331 contacts the rear inclined surface 411*b*.

The engaging slots 44 may be formed so that each of the ribs 212 of the mounting portion 21 makes a slide. The engaging slots 44 may be formed as a pair and disposed on the left and right sides of the unlock bar 41. As the ribs 212 of the mounting portion 21 are inserted into the engaging slots 44, the CPA member 4 may be engaged to the mounting portion 21. The engaging slots 44 may be disposed at lower ends of the CPA locking portion 43.

The CPA locking portion 43 may prevent the lever 3 from being rotated in the second direction. Referring to FIGS. 13 and 14, when the stopping portions 42 are unlocked and the CPA member 4 is moved toward the lever stop portion 22, the CPA locking portion 43 may slide over the locked portion 33 of the lever 3 to cover the locked portion 33. That is, when the stopping portions 42 are unlocked, the CPA locking portion 43 may lock the locked portion 33 to prevent the lever 3 from being rotated in the second direction.

To allow the CPA locking portion 43 to slide over the locked portion 33, the CPA locking portion 43 may be disposed at a predetermined interval above the stopping portions 42. In detail, an interval between the CPA locking portion 43 and the stopping portion 42 may be the thickness of the locked portion 33 or more.

In addition, the CPA member 4 may include a heel portion 46 disposed behind the CPA locking portion 43. The heel portion 46 may protrude on an upper surface of the CPA member 4. When an operator slides the CPA member 4 backward, the operator's fingers may be put on the heel portion 46.

The CPA member 4 may be detachably assembled to the mounting portion 21 of the cover 2 and thus be detached from the cover 2 when necessary.

Figure 15:
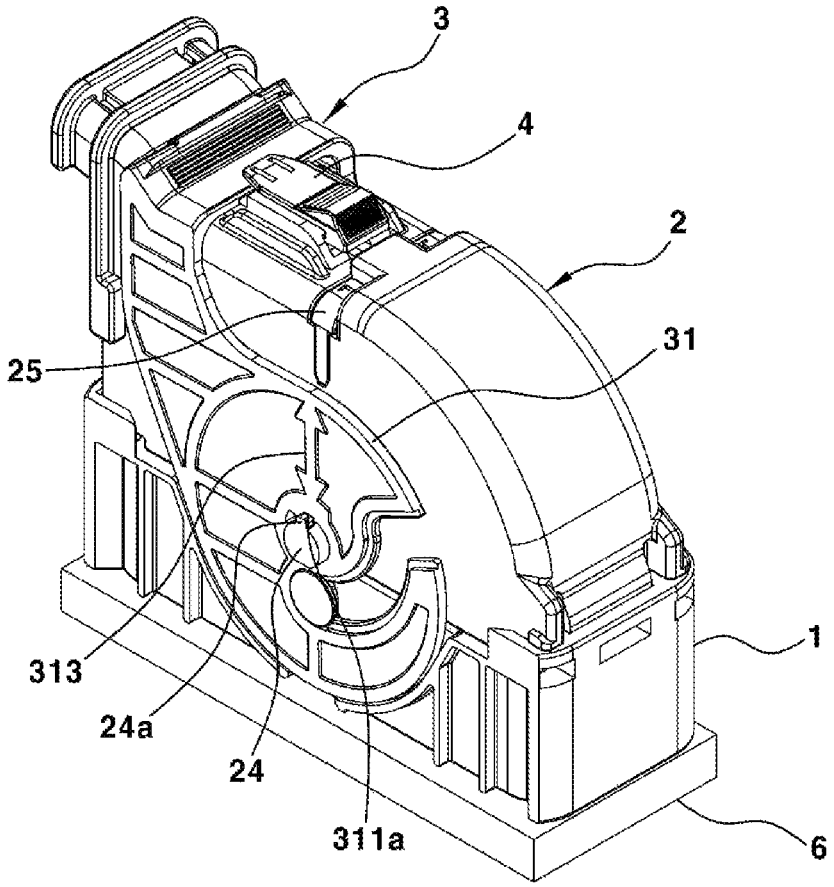
FIG. 15 is a side view illustrating a state in which a lever marker and a cover marker match each other when the lever is rotated.

Meanwhile, referring to FIGS. 2 and 15, the cover 2 may be provided with cover markers 25 disposed behind the mounting portion 21. The cover markers 25 may be detachably engaged to upper portions of the cover 2. Here, each lower portion of the cover markers 25 may be disposed on a side surface of the cover 2. To this end, the cover markers 25 may be bent in an upside down L-shape, and positioned on the upper portions of the cover 2, i.e. at a left edge portion and a right edge portion of the cover 2, respectively. The cover markers 25 may be disposed on a vertical line passing through the pin portions 24, respectively.

Lever markers 313 corresponding to the cover markers 25 may be formed on the rotating plate portions 31 of the lever 3. The lever markers 313 may be formed integrally with the rotating plate portions 31. Each lever marker 313 may be disposed at a position matching that of each cover marker 25.

When the inclined surface portion 32 of the lever 3 is mounted on the lever stop portion 22, that is, when the first connector 1 and the second connector 6 are completely engaged to each other, the lever markers 313 may be positioned in line with the cover markers 25 and the pin portions 24, respectively (see FIG. 15).

The cover markers 25 may be formed as separate components detachable from the upper portions of the cover 2

Figure 19:
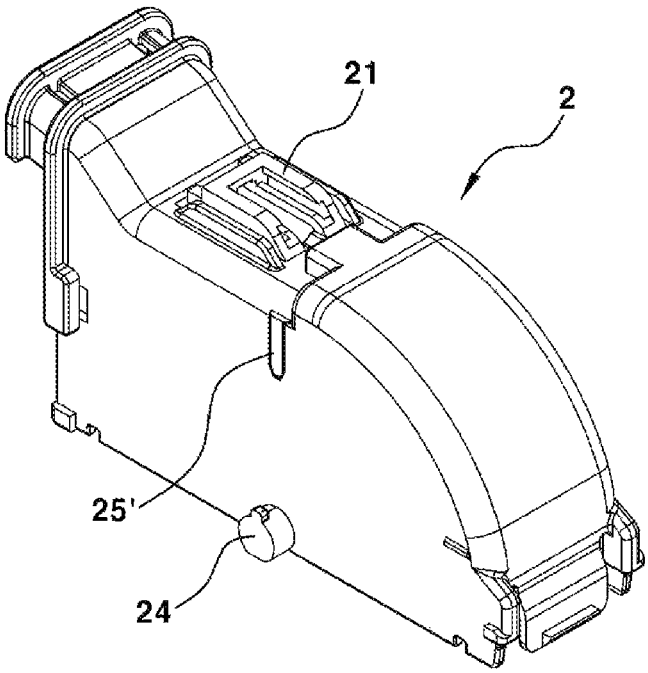
FIG. 19 is a perspective view illustrating a cover marker according to another embodiment of the present disclosure.

(see FIG. 2), or the cover markers 25' may be formed to be coated on the side surfaces of the cover 2 (see FIG. 19).

Here, there is described a process in which the CPA member 4 is automatically operated to lock the lever 3 when the lever 3 is rotated in the first direction.

Referring to FIG. 4, the CPA member 4 is prevented from being moved forward by the cover locking portion 211 before the lever 3 is rotated in the first direction.

Referring to FIGS. 11 and 12, when the lever 3 is rotated by the operator in the first direction, the inclined surface portion 32 of the lever 3 is mounted on the lever stop portion 22 and the locked portion 33 of the lever 3 is positioned on the unlock bar 41 of the CPA member 4. Here, the pressing protrusion 331 of the locked portion 33 may press an upper surface of the unlock bar 41, and the unlock bar 41 is thus bent downward with reference to a hinge point. The hinge point may be a rear end of the unlock bar 41.

When the unlock bar 41 is bent downward, the stopping portions 42 may be released from being caught by the cover locking portion 211. Accordingly, as the pressed portion 45 of the CPA member 4 is pushed forward by the compressed elastic member 5, the CPA locking portion 43 may slide over and lock the locked portion 33 (see FIGS. 13 and 14).

Referring to FIG. 13, the CPA member 4 may be pushed by the elastic member 5 until the cover locking portion 211 contacts and is caught by rear wall surfaces 421*b* of the grooves 421 and may thus move toward the lever stop portion 22. Each rear wall surface 421*b* of the grooves 421 may be formed to be vertical to prevent movement of the cover locking portion 211.

When the CPA member 4 and the lever 3 is completely engaged to each other as described above, the lever 3 is locked by the CPA member 4 and thus prevented from being rotated in the second direction. Therefore, it is possible to prevent the first connector 1 and the second connector from being disengaged from each other by the lever 3.

The first connector 1 and the second connector 6 are forcibly engaged to each other by a strong engagement force when the lever 3 is rotated in the first direction. Therefore, the inclined surface portion 32 may retain its position on the lever stop portion 22 until the lever 3 receives a force to rotate the lever 3 in the second direction.

Next, there is described a process in which the CPA member 4 locking the lever 3 as described above returns to its original position.

Figure 16:
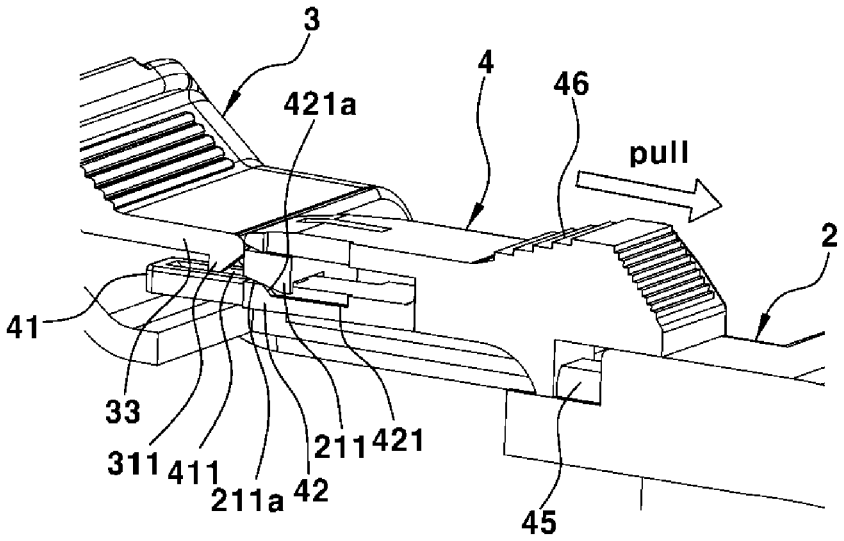
FIG. 16 is a cutaway perspective view illustrating a state in which the CPA member slides backward.

Referring to FIG. 16, first to disengage the CPA member 4 and the lever 3 from each other, the CPA member 4 covering the locked portion 33 of the lever 3 may be pulled backward to be moved. As the CPA member 4 slides backward, the CPA locking portion 43 may be separated from the locked portion 33, and the elastic member 5 may be pressed by the pressed portion 45 to be compressed. Here, the lever 3 may be in a state rotatable in the second direction.

As the CPA member 4 is moved backward, a lower surface 211*a* of the cover locking portion 211 and front wall surfaces 421*a* of the grooves 421 are in contact with each other, respectively. The lower surface 211*a* of the cover locking portion 211 is formed to be inclined, the cover locking portion 211 may thus slide along the front wall surfaces 421*a* of the grooves 421 to leave the grooves 421 and return to the front of the stopping portions 42.

Figure 17:
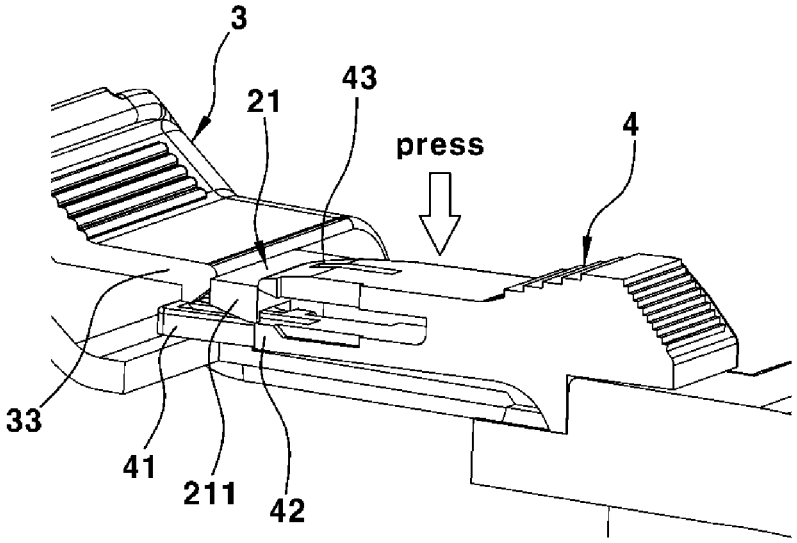
FIG. 17 is a cutaway perspective view illustrating a state in which a stopping portion is caught by a cover locking portion again.

Referring to FIG. 17, when the cover locking portion 211 returns to the front of the stopping portions 42, the pressing protrusion 331 of the locked portion 33 may press the upper surface of the unlock bar 41, and accordingly, the stopping portions 42 may be released from being caught by the cover locking portion 211 again. Therefore, in order to prevent the stopping portions 42 from being released from the caught again, the inclined surface portion 32 of the lever 3 may be pulled to rotate the lever 3 in the second direction while pressing the CPA member 4 downward.

Figure 18:
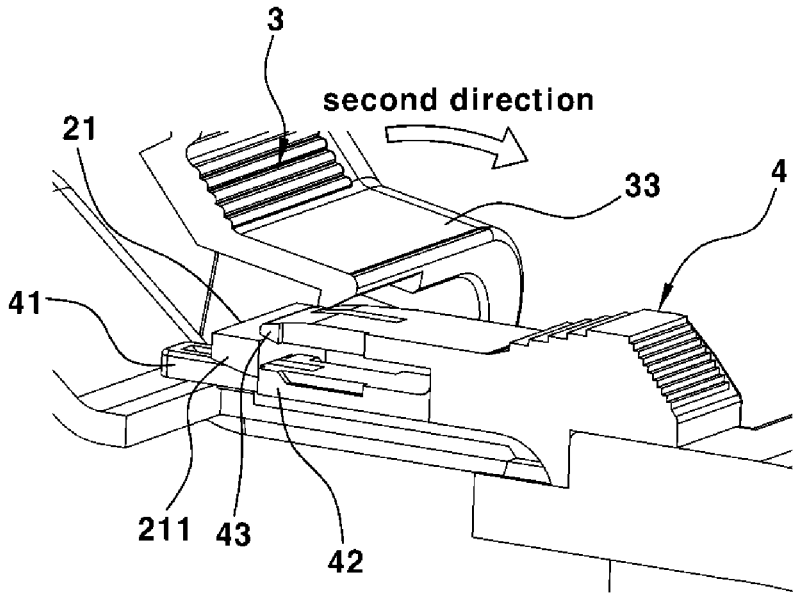
FIG. 18 is a cutaway perspective view illustrating a state in which the CPA member returns to its original position.

When pressed downward, the CPA member 4 may have the rear end of the mounting portion 21 as the hinge point and thus be pressed downward with the mounting portion 21. When the CPA member 4 is released from being pressed, the CPA member 4 and the mounting portion 21 may return to the positions thereof with reference to the hinge point; and here, the stopping portions 42 may keep a state of being caught by the cover locking portion 211 (see FIG. 18).

As the lever 3 is rotated in the second direction, the first connector 1 and the second connector 6 may be disengaged from each other.

According to the connector assembly in the present disclosure, the CPA member may be automatically operated to lock the lever when the lever completes its operation for engaging the first connector and the mating connector of the first connector to each other. Therefore, no additional work man-hour is necessary to operate the CPA member.

Hereinabove, although the embodiments of the present disclosure are described above in detail, the protection scope of the present disclosure is not limited thereto. Therefore, various changes and improved forms by those skilled in the art using basic concepts of the present disclosure defined in the following claims belongs to the protection scope of the present disclosure.

The invention claimed is:

1. A connector assembly comprising:

a cover covering one end of a first connector, the cover having a lower portion and an upper portion;

a lever rotatably engaged with the lower portion of the cover;

a connector position assurance (CPA) member slidably mounted to a mounting portion formed on the upper portion of the cover;

a cover locking portion formed on the mounting portion configured to restrict the CPA member from sliding toward a front of the mounting portion; and an elastic member disposed behind the mounting portion configured to press the CPA member toward a front of the mounting portion;

wherein when the lever is rotated in a first direction, the CPA member is released from a sliding restriction made by the cover locking portion, configured to slide toward the front of the mounting portion by the elastic member, and configured to lock the lever.

2. The connector assembly of claim 1, wherein a cover slot is disposed behind the mounting portion on the upper portion of the cover, and the elastic member is disposed adjacent to a pressed portion formed on a lower portion of the CPA member to be compressed and restored in the cover slot.

3. The connector assembly of claim 1, wherein the first direction is a rotational direction of the lever for engaging the first connector and a mating connector of the first connector to each other.

4. The connector assembly of claim 1, wherein the CPA member includes:

an unlock bar having a plurality of side surfaces and an upper surface, the unlock bar configured to be pressed downward by the lever when the lever is rotated in the first direction;

a plurality of stopping portions formed on the plurality of side surfaces of the unlock bar, wherein the stopping portions are configured to be caught by the cover locking portion and released from being caught by the cover locking portion when the unlock bar is pressed downward; and a CPA locking portion disposed at a predetermined interval on the upper surface of the unlock bar, the CPA locking portion being configured to slide over a locked portion of the lever when the plurality of stopping portions are released from being caught by the cover locking portion.

5. The connector assembly of claim 4, wherein when the CPA locking portion is mounted on the locked portion of the lever, the CPA locking portion prevents the lever from being rotated in a second direction which is opposite to the first direction.

6. The connector assembly of claim 4, wherein the CPA member includes a plurality of engaging slots disposed on both sides of the unlock bar, and when the CPA member is mounted on the mounting portion, ribs of the mounting portion are slid and inserted into the plurality of engaging slots.

7. The connector assembly of claim 4, wherein a plurality of grooves are formed on upper surfaces of the plurality of stopping portions, and the cover locking portion enters the plurality of grooves when the plurality of stopping portions are released from being caught by the cover locking portion.

8. The connector assembly of claim 7, wherein a lower surface of the cover locking portion is inclined and in contact with front wall surfaces of the plurality of grooves when the CPA member slides toward a rear of the mounting portion.

9. The connector assembly of claim 8, wherein only a rear end of the mounting portion is integrally connected to the upper portion of the cover and bendable with reference to the rear end thereof.

10. The connector assembly of claim 4, wherein the lever includes:

a plurality of rotating plate portions rotatably engaged with a plurality of pin portions formed on lower portions of the cover, respectively; and the locked portion of the lever being integrally formed with the plurality of rotating plate portions and pressing the unlock bar downward when the plurality of rotating plate portions are rotated in the first direction.

11. The connector assembly of claim 10, wherein a plurality of lever markers are formed on the plurality of rotating plate portions of the lever, and when the plurality of rotating plate portions are rotated in the first direction and the locked portion presses the unlock bar, the plurality of lever markers are positioned in line with a plurality of cover markers formed on side surfaces of the cover and the plurality of pin portions.

12. The connector assembly of claim 10, wherein a pressing protrusion is formed on a lower surface of the locked portion of the lever, and presses the upper surface of the unlock bar when the plurality of rotating plate portions are rotated in the first direction.

13. The connector assembly of claim 12, wherein an unlock groove portion is formed on the upper surface of the unlock bar, and the pressing protrusion enters the unlock groove portion when the plurality of stopping portions are released from being caught by the cover locking portion.

* * * * *